United States Patent [19]

Fiske, Jr.

[11] Patent Number: 4,923,114

[45] Date of Patent: May 8, 1990

[54] NEWSPAPER BOX SIGNAL DEVICE AND COVER

[76] Inventor: John M. Fiske, Jr., 1504 NE. 24th St., Jensen Beach, Fla. 34957

[21] Appl. No.: 406,251

[22] Filed: Sep. 12, 1989

[51] Int. Cl.[5] ..... B65D 91/00

[52] U.S. Cl. ..... 232/34; 232/1 C

[58] Field of Search ..... 232/1 C, 34, 35, 17

[56] References Cited

U.S. PATENT DOCUMENTS

| | | | |
|---|---|---|---|
| 3,960,316 | 6/1976 | Echterling | 232/1 C |
| 4,007,870 | 2/1977 | Hankis | 232/34 |
| 4,181,250 | 1/1980 | Withrow | 232/1 C |
| 4,412,646 | 11/1983 | Hollenbach | 232/34 |
| 4,721,244 | 1/1988 | Armstrong | 232/34 |
| 4,723,702 | 2/1988 | Martin | 232/1 C |

*Primary Examiner*—Robert W. Gibson, Jr.
*Attorney, Agent, or Firm*—Michael H. Minns

[57] ABSTRACT

A newspaper delivery indicating device combined with a closure to protect the newspaper from the elements.

An indicator flag is held in an upright visible position prior to newspaper delivery. The front of the flag may be used for name and address indicia to assist in correct delivery.

When the newspaper is placed in the newspaper box, the trigger elements disengage, the signal flag drops over the open end of the newspaper box, closing the open end and protecting the newspaper from the weather.

Delivery of the newspaper is indicated by the absence of the signal flag.

14 Claims, 3 Drawing Sheets

1
2
3
3
4
5
6
7
9
10
11
12

NEWSPAPER BOX SIGNAL DEVICE AND COVER

FIELD OF INVENTION

This invention relates to devices which signal the delivery of mail, periodicals and the like in an enclosed receptacle that is open at least one end, It more particularly relates to a device which covers the open end of the enclosed receptacle after delivery of mail, periodicals and the like.

BACKGROUND OF THE INVENTION

Conventional roadside newspaper delivery boxes are plastic elongated tubes, typically rectangular in cross-section. The rear end of a newspaper delivery box is closed. The front end, which faces the road, is open to permit easy delivery of the newspaper.

It is usually difficult to determine from the house if the newspaper has been delivered. In many instances, the open end of the newspaper delivery box faces away from the house and delivery can not be determined without walking to the box. In rural areas, where the houses are relatively far from the road, it is difficult to determine newspaper delivery, even when the open end of the box faces the house.

Because one end of the newspaper delivery box is open to facilitate delivery, the newspaper is exposed to the elements. It can become wet with rain, snow can drift into the box, mud and dirt can be splattered on the newspaper. Prior art doors and closures have been unpractical because of the time and subsequent delivery cost required to open the closure, insert the newspaper, close and secure the door.

The prior art devices are either signal devices or closure devices. None incorporate a signal with a door or closure. Examples of typical signal devices are Pat. Nos. 3,960,316, 4.007,870, and 4,721,244. The indicator shown in the Echterling patent, No. 3,960,316, drops below the newspaper delivery box when the newspaper is delivered. Echterling does not protect the newspaper from the weather. Since the Echterling signal device is below the newspaper delivery box, it is not readily seen from behind the box when it is mounted on a square post, such as the type shown in Echterling.

Both of the signal devices shown in Hankis, Pat. No. 4,007,870 and Armstrong, Pat. No. 4,621,244, are raised above the newspaper delivery box to indicate newspaper delivery. Neither device provides any protection from the weather after the newspaper has been delivered. All three of these signal devices are positive indicating means. Each raises or drops an indicator into a visible position when the newspaper is delivered.

An example of a typical closure for a newspaper delivery box is Pat. No. 4,732,702. This device does not signal delivery of the newspaper.

SUMMARY OF THE INVENTION

This invention provides a simple newspaper delivery indicator combined with a closure to protect the newspaper from the elements.

Before delivery, the indicator flag is in a raised visible position. When the newspaper is delivered, the delivery person inserts the newspaper into the newspaper delivery box, tripping a trigger element. The indicator flag drops over the open end of the box and protects the newspaper from the weather. Delivery of the newspaper is indicated by the absence of the indicator flag, since it is now in the lowered position where it is not visible.

To remove the newspaper, the indicator flag is raised to the indicating position. The newspaper is removed and the trigger element is reset to await delivery of the next day's newspaper.

Since the indicator flag is in the visible position before newspaper delivery, the front side of it, facing the road, can be used for the owner's name and address. The prior art devices do not have a readily visible portion that could be used for address information when in the non-indicating position. Since rural newspaper delivery boxes are remote from the house and frequently grouped together, positive address information can reduce delivery mistakes.

DETAILED DESCRIPTION OF THE INVENTION

The present invention is a signaling device that indicates the arrival of a newspaper, periodical, or the like in a delivery box such as the type used for newspapers. The present invention also covers the open end of the delivery box to protect the delivered article from the weather.

Conventional roadside newspaper delivery boxes 10 are typically plastic elongated tubes, rectangular in cross-section. The rear end of the newspaper delivery box 10 is closed. The front end, which faces the road, is open to permit easy delivery of the newspaper. Earlier versions of the newspaper delivery box 10 have been round in cross-section and were made out of sheet metal.

Figure 1:
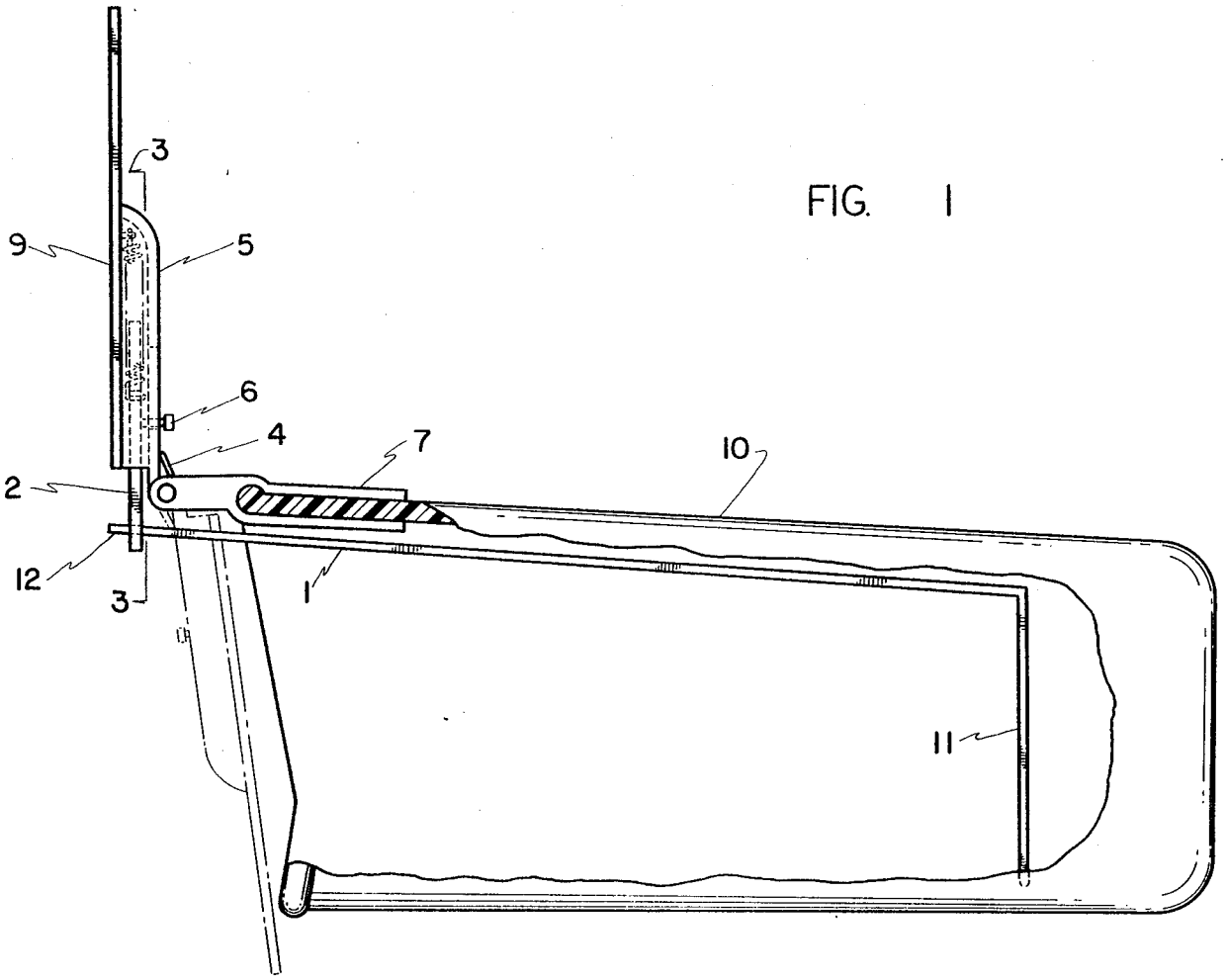
FIG. 1 is side view, partial cutaway of a newspaper delivery box with the present invention installed in the untripped position.

FIG. 1 shows a newspaper delivery box 10 fitted with a signal device of the present invention. The signal device shown in FIG. 1 is in the raised visible position which indicates that no delivery has taken place. The present invention differs from the prior art devices, which are positive indicating devices, in that the absence of the indicator or signal flag 9 indicates delivery.

The trigger element 1 blocks the inside of the newspaper delivery box 10. The rear plate 11 on the trigger element 1 must be pushed towards the rear of the newspaper delivery box 10 to insert a newspaper into the box. The length of the horizontal portion of the trigger element 1 is about the same as the width of a newspaper. This will ensure that the signal device is tripped when the newspaper is delivered. If the trigger element 1 is too short, the signal device will trip when the newspaper is only partially inserted into the newspaper delivery box 10. If the trigger element 1 is too long, the newspaper can be fully inserted into the newspaper delivery box 10 without tripping element 1 is such that the trigger element 1 will trip the signal device when the newspaper is just fully inserted into the newspaper delivery box 10.

Figure 2:
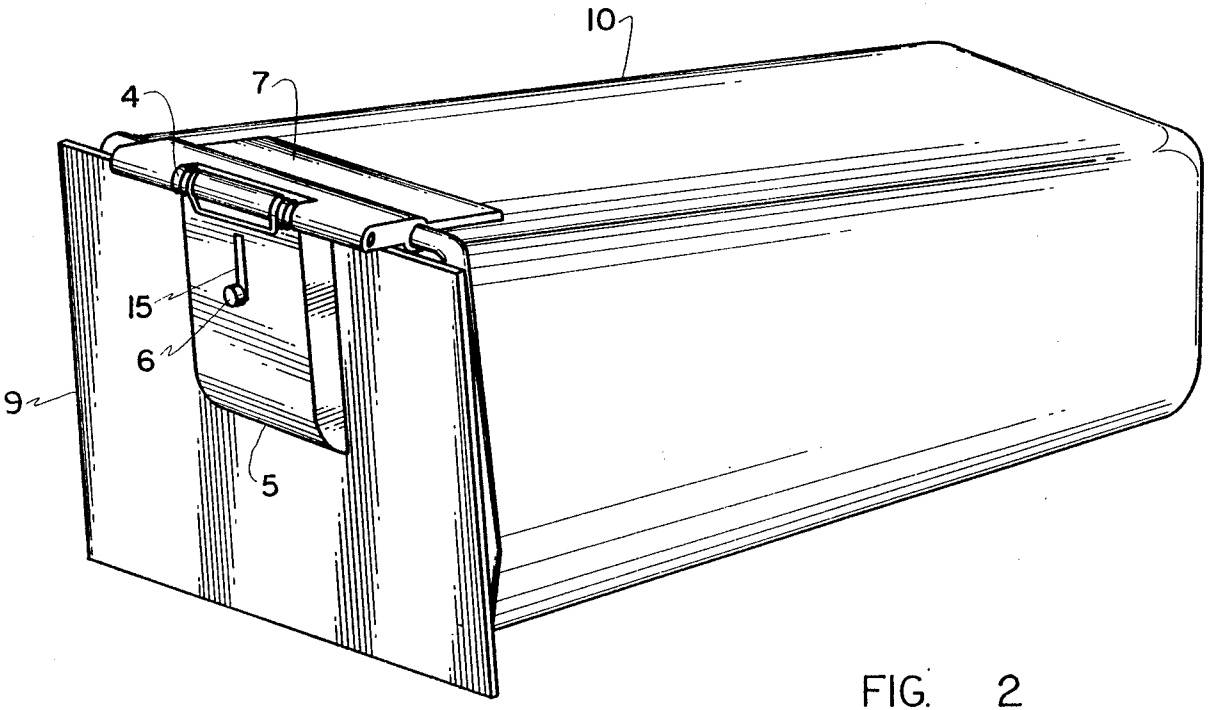
FIG. 2 is perspective view of a newspaper delivery box with the present invention installed in the tripped position.

The present invention uses a signal flag 9 which is held in a raised visible position, as shown in FIG. 1 to indicate no delivery. The signal flag 9 drops down as shown in FIG. 2 to cover the open end of the newspaper delivery box 10 and protect the newspaper from the elements. Compliant gasket material (not shown) can be applied to the signal flag 9 to provide a better seal to the newspaper delivery box 10.

Figure 4:
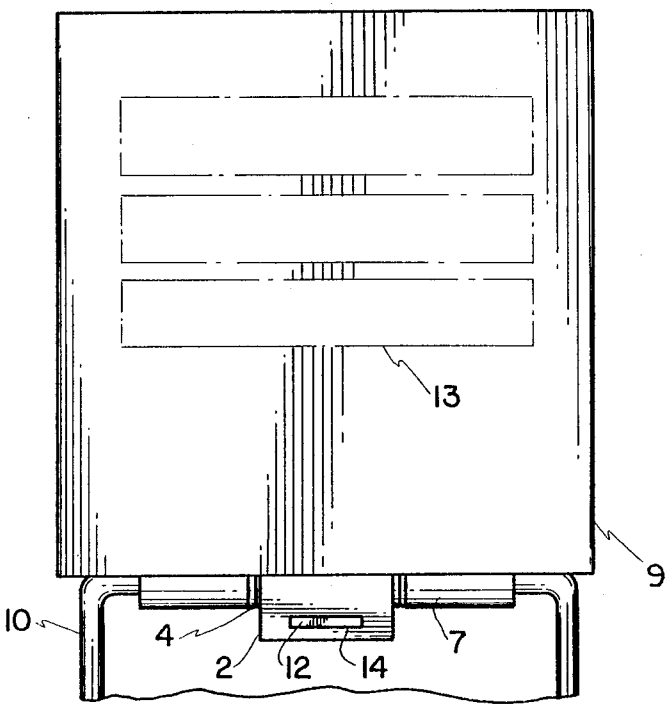
FIG. 4 is a front view of the signal flag showing name and address indicia.

When in the raised visible position, the signal flag 9 can have mean and address indicia 13 applied to it, as shown in FIG. 4. Newspaper delivery boxes 10 are often used in rural areas. The box 10 is usually mounted on a post or pole at a considerable distance from the house. Sometimes, several newspaper delivery boxes 10 are clustered together by the roadside. The name and address indicia 13 will ensure that a newspaper is placed in the correct newspaper delivery box 10 and will reduce delivery mistakes. Since the prior art signal devices use flags which trip into a visible position upon delivery, their signal flags can not be used for name and address indicia.

Figure 3:
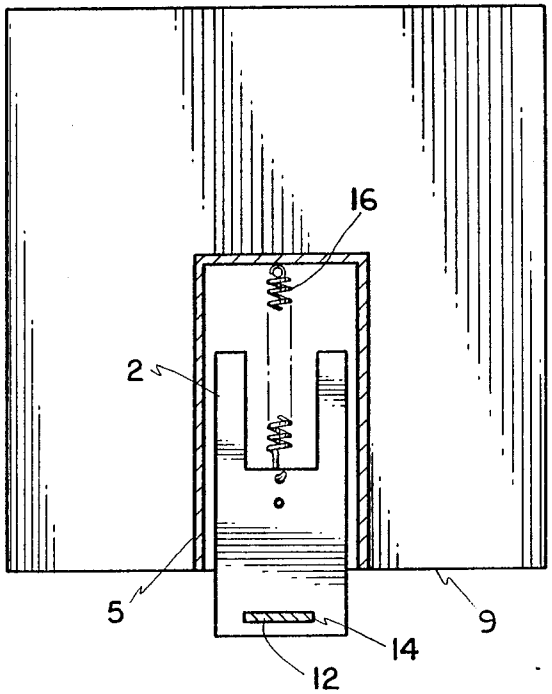
FIG. 3 is a section taken along the line 3—3 in FIG. 1 showing the detail of the slide.

The signal flag 9 is held in the raised visible position by a trigger mechanism. The trigger mechanism consists of a slide 2 which fits into a housing 5 on the signal flag 9. The trigger element 1 contains an area of reduced width 12 which fits into a slot 14 in the slide 2. The signal flag 9 is attached a torsion spring hinge 4. The torsion spring hinge 4 is attached to a u-shaped clamp 7 which slideably engages the newspaper delivery box 10. The tension of the torsion spring hinge 4 will force the signal flag 9 down against the open of the newspaper delivery box 10 when the trigger element 1 no longer engages the slide 2. Details of the slide 2 are shown in FIG. 3. Because of the torsion spring hinge 4, the newspaper delivery indicator can be mounted on any side of the newspaper delivery box 10.

An alternate configuration of the present invention uses gravity to close the signal flag 9 over the open end of the newspaper delivery box 10. The signal flag 9 is held at an obtuse angle to the long axis of the newspaper delivery box 10. The signal flag 9 may be manufactured with additional weights or material at its outer end to assist the closing of the signal flag 9 whenever a newspaper is delivered.

When a newspaper is delivered, it is inserted into the newspaper delivery box 10. As the newspaper is inserted, it pushes against the rear plate 11 of the trigger element 1. The trigger element 1 moves towards the rear of the newspaper delivery box 10 and the area of reduced width 12 disengages from the slot 14 in the slide 2. The torsion spring hinge 4 then forces the signal flag 9 down to close the open end of the newspaper delivery box 10. The closed signal flag 9 will protect the newspaper from the elements. The absence of the readily visible indicator signals the arrival of the newspaper.

The signal flag 9 is larger than the cross-section of the newspaper delivery box 10. Since the signal flag 9 extends beyond the edges of the box 10, the edges can be grasped to open the signal flag 9 to remove the newspaper.

A knob 6 is fastened to the slide 2. The bottom part of the knob 6 is a smaller diameter than the top of the knob 6. This allows the knob 6 to fit into a slot 15 in the housing 5. The knob 6 retains the slide 2 in the housing 5. The slot 15 allows the slide 2 to move into the housing 5 when the signal flag 9 closes. A small spring 16 is attached to the slide 2 to pull the slide 2 into the housing 5. This keeps the slide 2 from interfering with the torsion spring hinge 4.

After the newspaper has been removed, the signal flag 9 is raised to a vertical position. The knob 6 is used to move the slide 2 so that slot 14 can engage the area of reduced width 12 on the trigger element 1. The trigger element 1 is slid forward out of the newspaper delivery box 10 to engage the slot 14 in the slide 2. The signal device is now in the raised visible position indicating non-delivery and is ready to be tripped when the next day's newspaper is delivered. The torsion spring hinge 4 provides a small amount of tension to the slide 2 and the trigger element 1 to hold these elements engaged. This prevents wind and vibration from accidentally tripping the signal device.

I claim:

1. In a box-like receptacle having enclosing walls forming a substantially cylindrical shaped elongated enclosure, which receptacle is open at one end for insertion of printed matter such as newspapers and other printed matter, an apparatus to visually indicate the absence of such printed matter, which apparatus comprising:

(a) a signal flag element that is pivotally connected to an enclosing wall of said box-like receptacle, adjacent said open end;

(b) a first trigger element slideably connected to said signal flag element;

(c) a second trigger element which is comprised of a vertical member and a horizontal member, said horizontal member slideably engaging said first trigger element such that when said first and second trigger elements are in an untripped position, said signal flag element is substantially perpendicular to said enclosing wall, and when said first and second trigger elements are in a tripped position, said signal flag element is substantially perpendicular to said enclosing wall and substantially covering said open end of said box-like receptacle, said vertical member blocking at least a portion of the cross-section of said box-like receptacle so that placing said printed matter into the receptacle requires pushing said second trigger element to a tripped position and disengaging said second trigger element from said first trigger element; and (d) a biasing means whereby said signal flag element is forced from a position perpendicular to said enclosing wall to a position perpendicular to said enclosure wall and substantially covering said open end of said box-like receptacle whenever said first and second trigger elements are disengaged.

2. An apparatus as defined in claim 1 wherein said signal flag element has name and address indicia attached thereto.

3. An apparatus as defined in claim 1 wherein a torsion spring hinge pivotally connects said signal flag element to an enclosing wall of said box-like receptacle, adjacent said open end.

4. An apparatus as defined in claim 1 wherein a biasing means is connected to said first trigger element whereby said first trigger element moves away from said second trigger element, whenever said first and second trigger elements disengage.

5. An apparatus as defined in claim 1 wherein said second trigger element blocks a substantial portion of the cross-section of said box-like enclosure, said portion ranging from 20% of the area of the cross-section of said box-like enclosure to 95% of the area of the cross-section of said box-like enclosure.

6. An apparatus as defined in claim 1 wherein said signal flag element is substantially planar, having a cross-section area larger than the cross-section of said box-like enclosure.

7. An apparatus as defined in claim 1 wherein the length of the horizontal member of said second trigger element is such as to disengage said second trigger element from said first trigger element when said printed matter is fully inserted into said box-like enclosure.

8. In a box-like receptacle having enclosing walls forming a substantially cylindrical shaped elongated enclosure, which receptacle is open at one end for insertion of printed matter such as newspapers and other printed matter, an apparatus to visually indicate the absence of such printed matter, which apparatus comprising:

(a) a signal flag element that is pivotally connected to an enclosing wall of said box-like receptacle, adjacent said open end;

(b) a first trigger element slideably connected to said signal flag element;

(c) a second trigger element which is comprised of a vertical member and a horizontal member, said horizontal member slideably engaging said first trigger element such that when said first and second trigger elements are in an untripped position, said signal flag element is at an obtuse angle to and above said enclosing wall, and when said first and second trigger elements are in a tripped position, said signal flag element is substantially perpendicular to said enclosing wall and substantially covering said open end of said box-like receptacle, said vertical member blocking at least a portion of the cross-section of said box-like receptacle so that placing said printed matter into the receptacle requires pushing said second trigger element to a tripped position and disengaging said second trigger element from said first trigger element.

9. An apparatus as defined in claim 8 wherein said signal flag element has name and address indicia attached thereto.

10. An apparatus as defined in claim 8 wherein a biasing means is connected to said first trigger element whereby said first trigger element moves away from said second trigger element, whenever said first and second trigger elements disengage.

11. An apparatus as defined in claim 8 wherein said second trigger element blocks a substantial portion of the cross-section of said box-like enclosure, said portion ranging from 20% of the area of the cross-section of said box-like enclosure to 95% of the area of the cross-section of said box-like enclosure.

12. An apparatus as defined in claim 8 wherein said signal flag element is substantially planar, having a cross-section area larger than the cross-section of said box-like enclosure.

13. An apparatus as defined in claim 8 wherein the length of the horizontal member of said second trigger element is such as to disengage said second trigger element from said first trigger element when said printed matter is fully inserted into said box-like enclosure.

14. An apparatus as defined in claim 8 wherein the weight distribution of said signal flag element is such to encourage said signal flag element from a position above said enclosing wall to a position substantially perpendicular to said enclosing wall and substantially covering said open end of said box-like receptacle, whenever said first and second trigger elements are disengaged.

* * * * *

UNITED STATES PATENT AND TRADEMARK OFFICE

CERTIFICATE OF CORRECTION

PATENT NO. : 4,923,114

DATED : May 8, 1990

INVENTOR(S) : Fiske

It is certified that error appears in the above-identified patent and that said Letters Patent is hereby corrected as shown below:

In column 2, line 65 of the Patent, after "tripping" insert --the signal device. The ideal length for the horizontal portion of the trigger--

In column 3, line 10 of the Patent, change "mean" to --name--

Signed and Sealed this

Seventh Day of May, 1991

*Attest:*

HARRY F. MANBECK, JR.

*Attesting Officer*

*Commissioner of Patents and Trademarks*